US006524193B1

(12) United States Patent
Devore

(10) Patent No.: US 6,524,193 B1
(45) Date of Patent: Feb. 25, 2003

(54) GOLF PUTTER HEAD

(76) Inventor: Wallace E Devore, 1303 Old Railroad Bed Rd., Madison, AL (US) 35757

( * ) Notice: Subject to any disclaimer, the term of this patent is extended or adjusted under 35 U.S.C. 154(b) by 0 days.

(21) Appl. No.: 09/843,991

(22) Filed: Apr. 27, 2001

Related U.S. Application Data

(60) Provisional application No. 60/200,288, filed on Apr. 28, 2000.

(51) Int. Cl.[7] ..... A63B 69/36; A63B 53/04; A63B 53/02

(52) U.S. Cl. ..... 473/251; 473/330; 473/340; 473/349; 473/313

(58) Field of Search ..... 473/251, 324, 473/330, 331, 313, 340, 349, 558, 341; D21/736, 738, 742, 743, 746

(56) References Cited

U.S. PATENT DOCUMENTS 1,177,266 A * 3/1916 Pedersen
1,902,660 A * 3/1933 Nelson
3,955,819 A * 5/1976 Yokich
4,508,342 A * 4/1985 Drake
4,872,684 A * 10/1989 Dippel
5,090,698 A * 2/1992 Kleinfelter
5,433,441 A * 7/1995 Olsen
5,447,310 A * 9/1995 Jernigan
5,692,969 A * 12/1997 Schooler

* cited by examiner

*Primary Examiner*—Sebastiano Passaniti
(74) *Attorney, Agent, or Firm*—Joseph H. Beumer

(57) ABSTRACT

A golf putter head has a cylindrical body with a defined flat face on top, the body made up of an outer shell of an aluminum alloy and an inner core of brass. The head has a groove across the flat face of the top and at its center, with indicator material carried in the groove for alignment purposes. The head is sized so that the convex surface of the cylindrical body at its widest point will strike a golf ball at its corresponding widest point, thus providing for quick rolling action of the ball when putted. The combined outer shell/inner core structure is used to obtain favorable "feel" and balance properties.

7 Claims, 1 Drawing Sheet

GOLF PUTTER HEAD

CROSS REFERENCE TO RELATED APPLICATION

This application clams the benefit of provisional application Ser. No. 60/200,288, filed Apr. 28, 2000.

FIELD OF THE INVENTION

This invention relates to golf clubs and more particularly to putters having a cylindrical head.

BACKGROUND OF THE INVENTION

Putters are used in golf for the final approach to a hole where a high degree of accuracy is more important than distance. Various types of putters have been designed in an effort to obtain improvements in accuracy. These designs have taken into account a wide variety of factors, including shape and surface characteristics of the putter head striking face, putter head material, weight, balance, shaft placement, and sighting capability.

While most putter heads have been generally rectangular in shape, with a flat striking face, some designs have employed cylindrical heads that present a uniformly convex striking face. This type of putter is exemplified by U.S. Pat. Nos. 5,433,441 issued Jul. 18, 1995 to Olsen. et al 5,501,461 issued Mar. 26, 1996 to Donofrio.

It is desired to provide a putter head having the uniformly curved striking face of a cylinder, consistent with optimum surface characteristics, size, weight, and alignment capability, along with favorable balance and "sweet spot" properties. Certain materials of construction may provide an optimum result in one aspect such as surface characteristics or "feel", but fail to meet other requirements in particular a weight favorable for obtaining effective balance.

SUMMARY OF THE INVENTION

The present invention is directed to a golf putter having a generally cylindrical head made up of an outer tube of a metal such as aluminum having a medium hardness at the surface, and an inner rod of a heavy metal or metal-like material disposed along the length of the head inside of and secured to the outer tube. The outer tube is selected to provide a favorable "feel", consistent with other properties relating to surface characteristics, and the inner rod is selected to obtain an overall weight effective for optimum balance of the putter, which may be from 320 to 400 grams.

The outer surface of the head may be uniformly rounded except for a hat face defined along the length thereof and at the top side of the head when located in it normal horizontal position. At least one alignment indicator is provided in a groove extending across the flat face at its center.

A putter shaft may be mounted in a hole drilled into the flat face at a selected location and selected angle, using previously known techniques.

The diameter of the cylindrical head is selected so that the forward convex area, which becomes the striking surface of the putter head, is located at the same height as the center of the ball, with a slight allowance being made for lifting the putter to clear the ground during a stroke. Contacting the ball in this manner provides a quick rolling action and avoids skidding and spinning effects produced by other putters.

Putters embodying the invention are also characterized by favorable properties, including good balance and "sweet spot" features in addition to "feel".

DESCRIPTION OF THE PREFERRED EMBODIMENT

Figure 1:
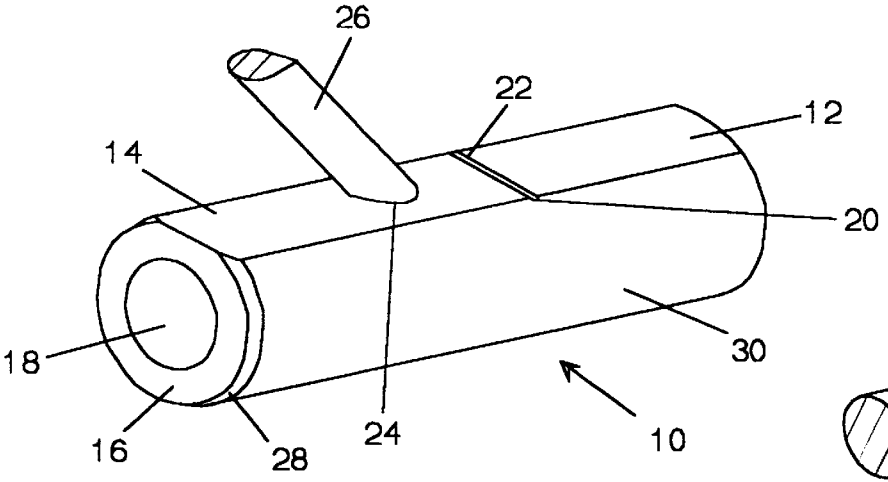
FIG. 1 is a perspective view of a putter head embodying the invention.
Figure 2:
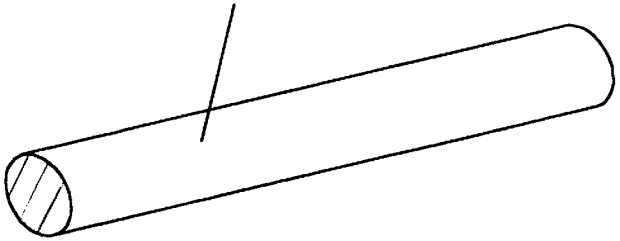
FIG. 2 is a perspective view of a heavy metal rod incorporated within the putter head of FIG. 1.

Referring to FIG. 1 of the drawings, there is shown a golf putter head 10 of generally cylindrical configuration, with a flat face 12 defined along the length of the head at topside 14 of the head when placed in the horizontal position in which it is used. The head is comprised of a tubular outer shell 16 of a selected metallic material having medium hardness. Aluminum alloy designated as 6061, T6 is suitable for this purpose. A cylindrical shaped rod 18 of a heavy metallic material is disposed within the aluminum shell to provide a desired overall weight, in particular, 300 to 400 grams. "Half-hard" brass is preferred for use in combination with the aluminum alloy referenced above because of its ideal density and corrosion resistance. Other heavy metallic materials such as tungsten, stainless steel and similar metals as well as metal carbides may also be used. In manufacturing the putter head the central rod may be secured within the shell by use of an epoxy adhesive.

A groove 20 perpendicular to side edges of flat face 12 extends across the flat face of the center of the length of the head. An indicator for alignment purposes may be obtained by anodizing the aluminum head in a process controlled to obtain a color for stripe 22 in the groove which contrasts with the color of the rest of the head. In particular, the head may be "blackanodized" by a JMV anodizing process to produce the overall black color, with the white stripe obtained in a subsequent step. Other contrasting color combinations may also be used.

Hole 24, drilled into the head at flat face 12, is provided to enable mounting of a shaft. The location of the hole and the angle at which it is placed may be selected in accordance with conventional procedures, depending on the height of the user and the type of shaft used.

Figure 3:
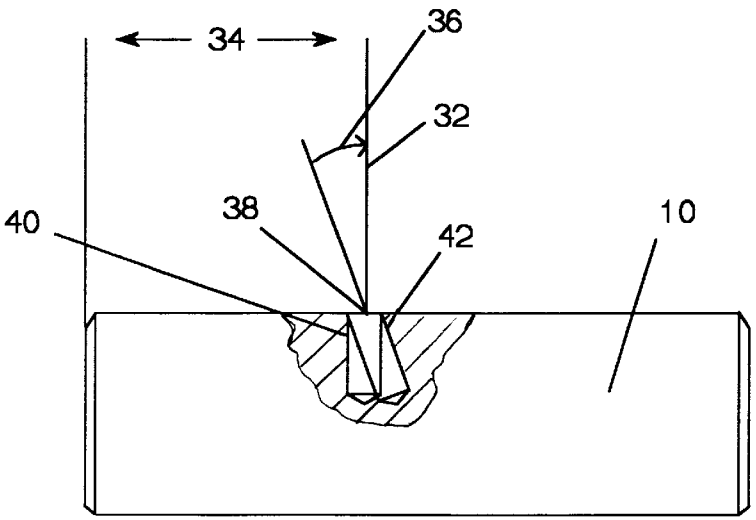
FIG. 3 is a side view showing locations for placement of an angular hole in which a shaft is to be mounted.
Figure 4:
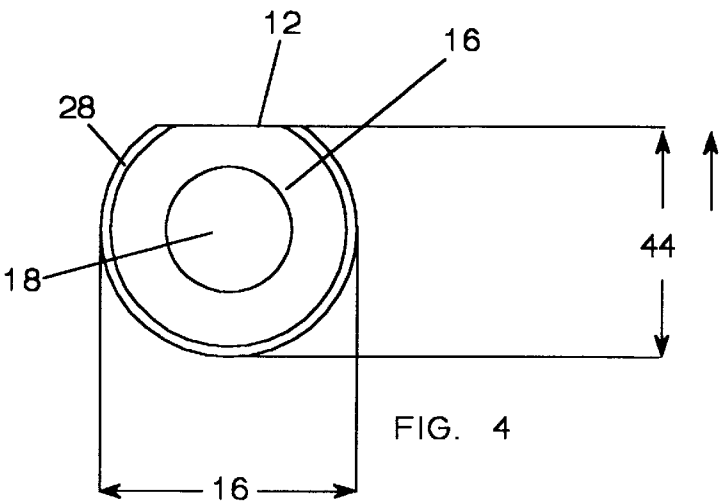
FIG. 4 is an end view of the putter head of FIG. 1.

FIG. 3 shows various angles for the hole at selected locations along the length of the head. In this illustration, the head has an overall length of 3.730 inches, and an intermediate location at line 32 is spaced apart a distance 34 to the nearest end, a specific distance of 1.37 inches. A selected angle 36 of a hole entering the head at a point 38 is depicted, along with other possible angles 40 and 42. Angles from 0 to 19 degrees with respect to the vertical may be selected. The hole 24 for the shaft 26 is preferably drilled to extend slightly beyond the axis of the central rod 18.

The head preferably has sharp edges of the outer shell 16 rounded off around the periphery 28 at both ends to avoid presenting a dangerous cutting edge. Contact with a target golf ball is made by convex striking surface 30, which extends along the length of the head. Putting surface 30 in this figure is in position for use by a left-handed golfer. An identical surface is provided on the opposite side of the head for right-handed golfers.

Illustrative dimensions for the putter head shown in FIGS. 1–4 may be as follows: central rod 18, diameter, 0.625 inch; length 3.730 inches; outer shell 16, diameter 1.25 inches; length 3.730 inches; distances 44 from flat face 13 to opposite side, 1.16 inches. An overall length of 3-½ to 4-½ inches is preferred.

The alignment indicator 22 provides a means for sighting and placing the putter so that the length of the head forms a right angle with respect to a putting line. Additional stripes may be included, if desired.

The putter head described above provides a balanced effect, centering on the central groove and a large sweet spot also centered at the same location.

While the invention is described above in terms of a specific embodiment, it is not to be understood as so limited, but is limited only as indicated by the following claims.

What is claimed is:

1. A golf putter head comprising:

a generally cylindrical body, said body including an outer tubular shell having an exterior diameter and an interior diameter defining a wall thickness therebetween and an inner solid rod having a diameter and being disposed axially within said outer shell along an entire length thereof and connected thereto, said wall thickness being generally one-half said rod diameter;

said tubular shell made of an aluminum alloy having a T-scale hardness of T4–T7;

said inner rod made of a heavy metal; and said putter having a weight of 320 to 400 grams.

2. The golf putter head as defined in claim 1 including a flat face defined in an outer surface of said tubular member along a top side of said body.

3. The golf putter head as defined in claim 1 wherein said alloy comprises aluminum alloy 6061 T-6.

4. The golf putter head as defined in claim 3 wherein said rod is comprised of brass.

5. The golf putter head as defined in claim 4 wherein said outer tubular member has a diameter of 1.25 inches and said rod has a diameter of 0.625 inch.

6. The golf putter head as defined in claim 5 wherein said putter head has a length of 3.5 to 4.5 inches.

7. The golf putter head as defined in claim 2 including an indicator strip disposed across said flat face in a direction normal to a central axis of said rod.

* * * * *